US010012952B2

(12) United States Patent
Uchida

(10) Patent No.: US 10,012,952 B2
(45) Date of Patent: Jul. 3, 2018

(54) IMAGE FORMING APPARATUS FOR CONTROLLING AMOUNT OF AIR FLOW FLOWING TO HEAT UNIT IN FIXING DEVICE

(71) Applicant: Brother Kogyo Kabushiki Kaisha, Nagoya-shi, Aichi-ken (JP)

(72) Inventor: Norio Uchida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/255,637

(22) Filed: Sep. 2, 2016

(65) Prior Publication Data

US 2017/0082972 A1 Mar. 23, 2017

(30) Foreign Application Priority Data

Sep. 17, 2015 (JP) ..... 2015-183567

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
CPC ..... G03G 21/206; G03G 15/2017
USPC ..... 399/92
See application file for complete search history.

(56) References Cited

U.S. PATENT DOCUMENTS

| | | | | |
|---|---|---|---|---|
| 5,878,304 | A * | 3/1999 | Watanabe | G03G 21/1832 399/114 |
| 8,725,025 | B2 | 5/2014 | Murasaki | |
| 8,855,516 | B2 | 10/2014 | Koyama et al. | |
| 8,909,088 | B2 | 12/2014 | Murooka | |
| 9,025,989 | B2 | 5/2015 | Murasaki | |
| 9,081,340 | B2 | 7/2015 | Suzuki | |
| 2012/0282002 | A1 | 11/2012 | Murasaki | |
| 2012/0308256 | A1* | 12/2012 | Suzuki | G03G 15/2042 399/92 |
| 2012/0328323 | A1 | 12/2012 | Murooka | |
| 2013/0078016 | A1 | 3/2013 | Koyama et al. | |

(Continued)

FOREIGN PATENT DOCUMENTS

| | | | |
|---|---|---|---|
| JP | H01-85856 | U | 6/1989 |
| JP | H05-134513 | A | 5/1993 |
| JP | H09-44025 | A | 2/1997 |

(Continued)

*Primary Examiner* — Billy Lactaoen
(74) *Attorney, Agent, or Firm* — Banner & Witcoff, Ltd.

(57) ABSTRACT

A fixing device includes: a heat unit extending in an axial direction and comprising a heater, the heat unit having a central region in the axial direction and an end region outside of the central region; an opponent member to face the heat unit; and a cover positioned opposite to the opponent member with respect to the heat unit. The cover has: a central cover portion positioned to face the central region and spaced away from the central region by a reference distance; and a side cover portion positioned to face the end region and movable between a first position providing a first distance from the heat unit and a second position providing a second distance from the heat unit, the first distance being not more than the reference distance, and the second distance being greater than the reference distance.

20 Claims, 7 Drawing Sheets

(56) References Cited

U.S. PATENT DOCUMENTS

| | | | | |
|---|---|---|---|---|
| 2014/0112680 | A1* | 4/2014 | Ueno | G03G 15/2017 399/92 |
| 2014/0212165 | A1 | 7/2014 | Murasaki | |

FOREIGN PATENT DOCUMENTS

| | | | |
|---|---|---|---|
| JP | 2001-142544 | A | 5/2001 |
| JP | 2005-077877 | A | 3/2005 |
| JP | 2012-234067 | A | 11/2012 |
| JP | 2012-252194 | A | 12/2012 |
| JP | 2013-007777 | A | 1/2013 |
| JP | 2013-068772 | A | 4/2013 |

* cited by examiner

IMAGE FORMING APPARATUS FOR CONTROLLING AMOUNT OF AIR FLOW FLOWING TO HEAT UNIT IN FIXING DEVICE

CROSS REFERENCE TO RELATED APPLICATION

This application claims priority from Japanese Patent Application No. 2015-183567 filed Sep. 17, 2015. The entire content of the priority application is incorporated herein by reference.

TECHNICAL FIELD

The present disclosure relates to an image forming apparatus, a fixing device, and a method for restraining temperature increase at end portions of the fixing device.

BACKGROUND

An image forming apparatus includes a process unit for forming a toner image on a sheet, and a fixing device for fixing the toner image to the sheet. The fixing unit includes a heat unit extending in an axial direction and provided with a heater, and an opponent member facing the heat unit in a direction perpendicular to the axial direction. The sheet on which the toner image has been formed is nipped between the heater unit and the opponent member while being conveyed, and is heated by the heat unit, to thus thermally fix the toner image to the sheet.

In such a conventional fixing device, end regions of the heat unit in the axial direction have a temperature higher than that of a central region of the heat unit in the axial direction. For example, in case of successive printing to a plurality of sheets whose width in the axial direction is smaller than the axial length of the heat unit, the plurality of sheets draw heat from the central region of the heat unit, whereas heat can be accumulated at the end regions of the heat unit because the plurality of sheets are not in contact with the end portions. Accordingly, temperature at the end regions is higher than that of the center region.

Japanese Patent Application Publication No. 2012-234067 discloses an image forming apparatus provided with a fan and an assembly for changing an opening width. The fan is provided in confrontation with the end region of the heat unit. The assembly is provided between the heat unit and the fan, and is formed with an opening allowing fan-air to pass therethough. A slide plate is slidably movable in an axial direction of the heat unit for changing a width of the opening to restrain temperature increase at the end region of the heat unit.

Further, Japanese Patent Application Publication No. 2001-142544 discloses an image forming apparatus provided with a cover at a position between a heat unit and a housing of the image forming apparatus in order to retain heat of the heat unit.

SUMMARY

The present inventor has discovered that a resultant structure becomes complicated if the fan and the assembly for changing the opening width are incorporated to the apparatus disclosed in JP'544 publication.

It is therefore an object of the disclosure to provide an image forming apparatus having a simple construction.

Another object of the disclosure is to provide a method for restraining temperature increase at end portions of a fixing device.

According to one aspect, there is provided an image forming apparatus comprising a housing comprising a fan, and a wall portion forming an air passage in communication with the fan; and a fixing device comprising: a heat unit provided in the air passage and extending in an axial direction, the heat unit comprising a heater, the heat unit having a central region in the axial direction and an end region positioned outside of the central region in the axial direction; an opponent member provided to face the heat unit in a direction perpendicular to the axial direction; and a cover positioned in the air passage at a position between the heat unit and the wall portion. The cover comprises: a central cover portion positioned to face the central region and spaced away from the central region by a reference distance; and a side cover portion positioned to face the end region and movable between a first position providing a first distance from the heat unit and a second position providing a second distance from the heat unit, the first distance being equal to or less than the reference distance, and the second distance being greater than the reference distance.

According to another aspect, there is provided a fixing device comprising: a heat unit extending in an axial direction and comprising a heater, the heat unit having a central region in the axial direction and an end region positioned outside of the central region in the axial direction; an opponent member provided to face the heat unit in a direction perpendicular to the axial direction; and a cover positioned opposite to the opponent member with respect to the heat unit. The cover comprises: a central cover portion positioned to face the central region and spaced away from the central region by a reference distance; and a side cover portion positioned to face the end region and movable between a first position providing a first distance from the heat unit and a second position providing a second distance from the heat unit, the first distance being equal to or less than the reference distance, and the second distance being greater than the reference distance.

According to still another aspect, there is provided a method for restraining temperature increase of an axial end region of a fixing device, the fixing device being positioned in an image forming apparatus having a fan, and a wall portion constituting an air passage in communication with the fan. The fixing unit includes a heat unit, an opponent member and a cover, the heat unit being provided in the air passage and extending in an axial direction, the heat unit including a heater and having a central region in the axial direction and an end region positioned outside of the central region in the axial direction, the opponent member being provided to face the heat unit in a direction perpendicular to the axial direction; and the a cover being positioned in the air passage at a position between the heat unit and the wall portion, the cover including a central cover portion positioned to face the central region and spaced away from the central region by a reference distance, and a side cover portion positioned to face the end region. The method comprises moving the side cover portion from a first position providing a first distance from the heat unit to a second position providing a second distance from the heat unit, the first distance being equal to or less than the reference distance, and the second distance being greater than the reference distance.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
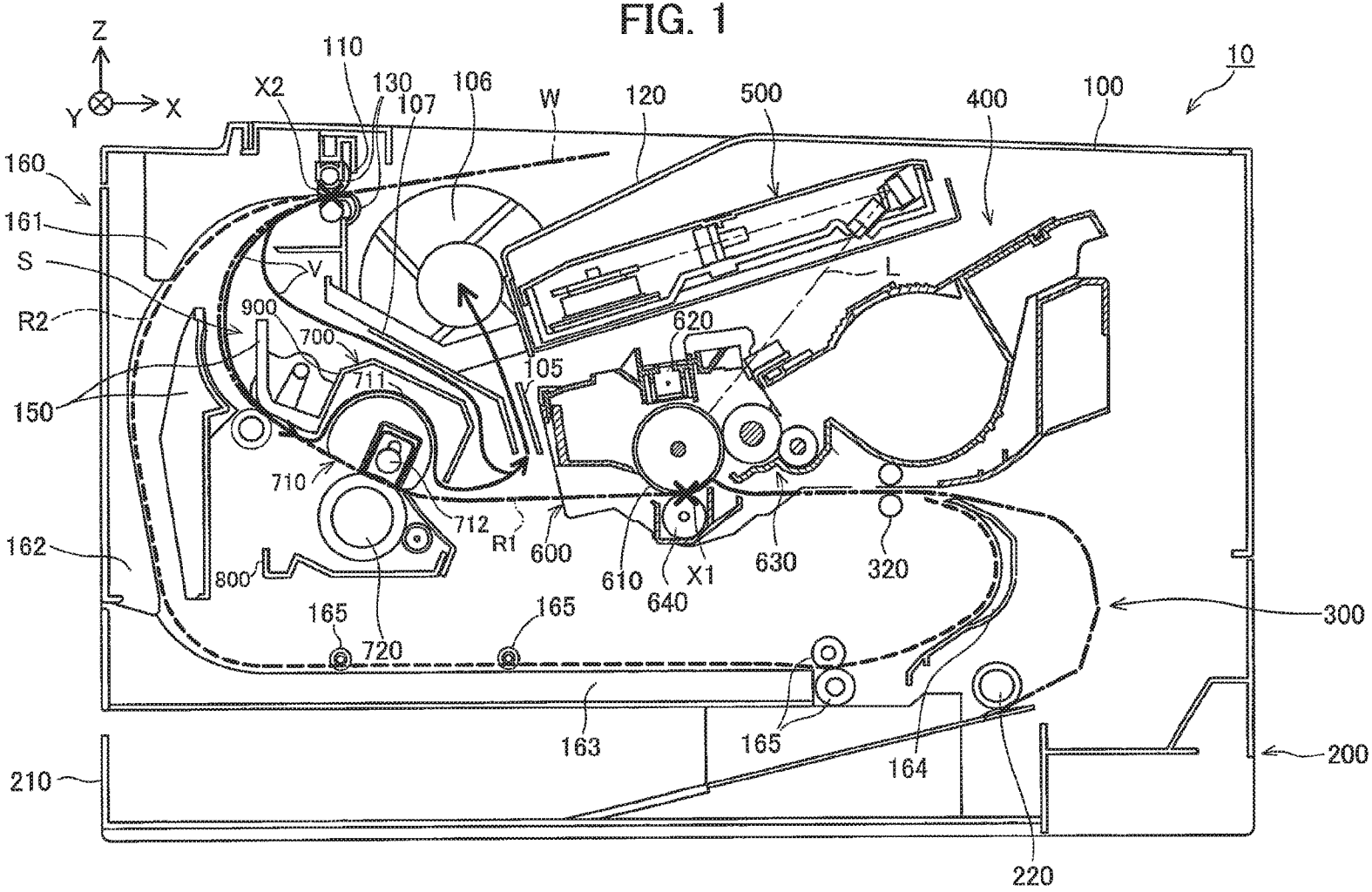
FIG. 1 is a schematic view of a printer as an example of an image forming apparatus according to one embodiment.

A printer 10 according to one embodiment will be described while referring to the accompanying drawings. In FIG. 1, directions X, Y, Z directing perpendicular to each other are shown. Throughout the specification, +Z (plus Z) direction and −Z (minus Z) direction will be referred to as upward and downward, respectively, +X direction and −X direction will be referred to as frontward and rearward, respectively, and +Y direction and −Y direction will be referred to as rightward and leftward, respectively.

The printer 10 is an electro-photographic type printer using a developing agent of single color, such as a black toner for forming a monochromatic image on a sheet W such as a plain paper and an OHP sheet. The printer 10 is an example of an image forming apparatus.

As shown in FIG. 1, the printer 10 includes a housing 100, a sheet supply unit 200, a sheet conveying portion 300, and an image forming unit 400, those being accommodated in the housing 100. The housing 100 has an upper portion formed with a sheet discharge opening 110 and a discharge tray 120. A pair of discharge rollers 130 is provided in the housing 100 at a position adjacent to the sheet discharge opening 110.

The sheet supply unit 200 includes a tray 210, and a pick-up roller 220. The tray 210 is adapted to accommodate a stack of sheets W. The pick-up roller 220 is adapted to pick up a single sheet W from the sheet stack in the tray 210, and to convey the sheet W to the image forming unit 400.

The image forming unit 400 includes an exposure unit 500, a process unit 600, and a fixing unit 700. The exposure unit 400 is adapted to irradiate laser beam L (optical beam) to a photosensitive member 610 in the process unit 600.

The process unit 600 includes the photosensitive member 610, a charger 620, a developing unit 630, and a transfer roller 640. The charger 620 is adapted to uniformly charge a surface of the photosensitive member 610. Upon irradiation of the laser light L from the exposure unit 500 to the surface of the photosensitive member 610 that has been charged by the charger 620, an electrostatic latent image is formed on the surface of the photosensitive member 610. Further, the developing unit 630 is adapted to supply toner to the surface of the photosensitive member 610. Toner image corresponding to the electrostatic latent image is formed on the surface of the photosensitive member 610 upon toner supply. The toner image formed on the surface of the photosensitive member 610 is transferred onto the sheet W by the transfer roller 640 when the sheet W passes through a position at which the photosensitive member 610 and the transfer roller 640 are in confrontation with each other. This position will be referred to as a transferring position X1.

The fixing unit 700 is adapted to heat the sheet W moved past the process unit 600 for thermally fixing the toner image to the sheet W. Thus, a visible toner image is fixed to the sheet W. The fixing unit 700 includes a heat unit 710 and an opponent member 720. A further detail of the fixing unit 700 will be described later.

The discharge rollers 130 are adapted to discharge the sheet W moved past the fixing unit 700 to the discharge tray 120 through the discharge opening 110. In the following description, a sheet passage extending from the sheet supply unit 200 to the discharge rollers 130 through the sheet conveying portion 300, the transferring position X1, and the fixing unit 700 will be referred to as "conveying passage R1", and a direction of sheet conveyance along the conveying passage R1 will be referred to as "conveying direction".

The housing 100 is provided with a conveying guide 150 positioned downstream of the fixing unit 700 in the conveying direction. The conveying guide 150 has a bending portion directing the sheet W that has been moved past the fixing unit 700 toward the discharge rollers 130.

The housing 100 is also provided with a re-conveying portion 160 for directing the sheet W that has been moved past the fixing unit 700 toward the process unit 600 after the sheet W is turned upside down. More specifically, the re-conveying portion 160 includes the discharge rollers 130, a first through fourth re-conveying guides 161 through 164, and a plurality of rollers 165. The first through fourth re-conveying guides 161 through 164 form a re-conveying passage R2 starting from the discharge rollers 130 and passing behind the conveying guide 150, below the image forming unit 400 and behind the sheet conveying portion 300. In the following description a direction of sheet conveyance along the re-conveying passage R2 will be referred to as "re-conveying direction".

The first re-conveying guide 161 is positioned opposite to the fixing unit 700 with respect to the conveying guide 150, and has a portion extending toward a rear position of the conveying guide 150 from a position closer to the discharge rollers 130 than the conveying guide 150 to the discharge rollers 130. The second re-conveying guide 162 is positioned rearward of the conveying guide 150 and has a portion extending in upward/downward direction. The third re-conveying guide 163 is positioned below the process unit 600 and the fixing unit 700 and above the sheet supply unit 200, and has a portion extending in frontward/rearward direction. The fourth re-conveying guide 164 is positioned between the third re-conveying guide 163 and registration rollers 320, and is U-shaped having a portion adjacent to the third re-conveying guide 163 and extending toward the registration rollers 320. The plurality of rollers 165 are positioned along the third re-conveying guide 163, and are adapted to be rotated by a driving force from a main motor (not shown). The pair of discharge rollers 130 is rotatable in forward and reverse directions by a driving force from a discharge motor (not shown). In the following description, a confronting position between the pair of discharge rollers 130 will be referred to as "discharge position X2".

A duct 105 is provided in the housing 100, and an air discharge fan 106 is provided at one end of the duct 105. The duct 105 has another end in communication with an outside of the housing 100 through a space S for accommodating therein the fixing unit 700 and the discharge opening 110.

Air stream V as indicated by a solid line arrow from the discharge opening 110 into the duct 105 through the space S is generated upon rotation of the fan 106. A wall portion 107 extending in frontward/rearward direction is provided in the housing 100 at a position above the fixing unit 700 or above the accommodation space S. The wall portion 107 constitutes a part of the duct 105. The accommodation space S is an example of an air passage.

Figure 2:
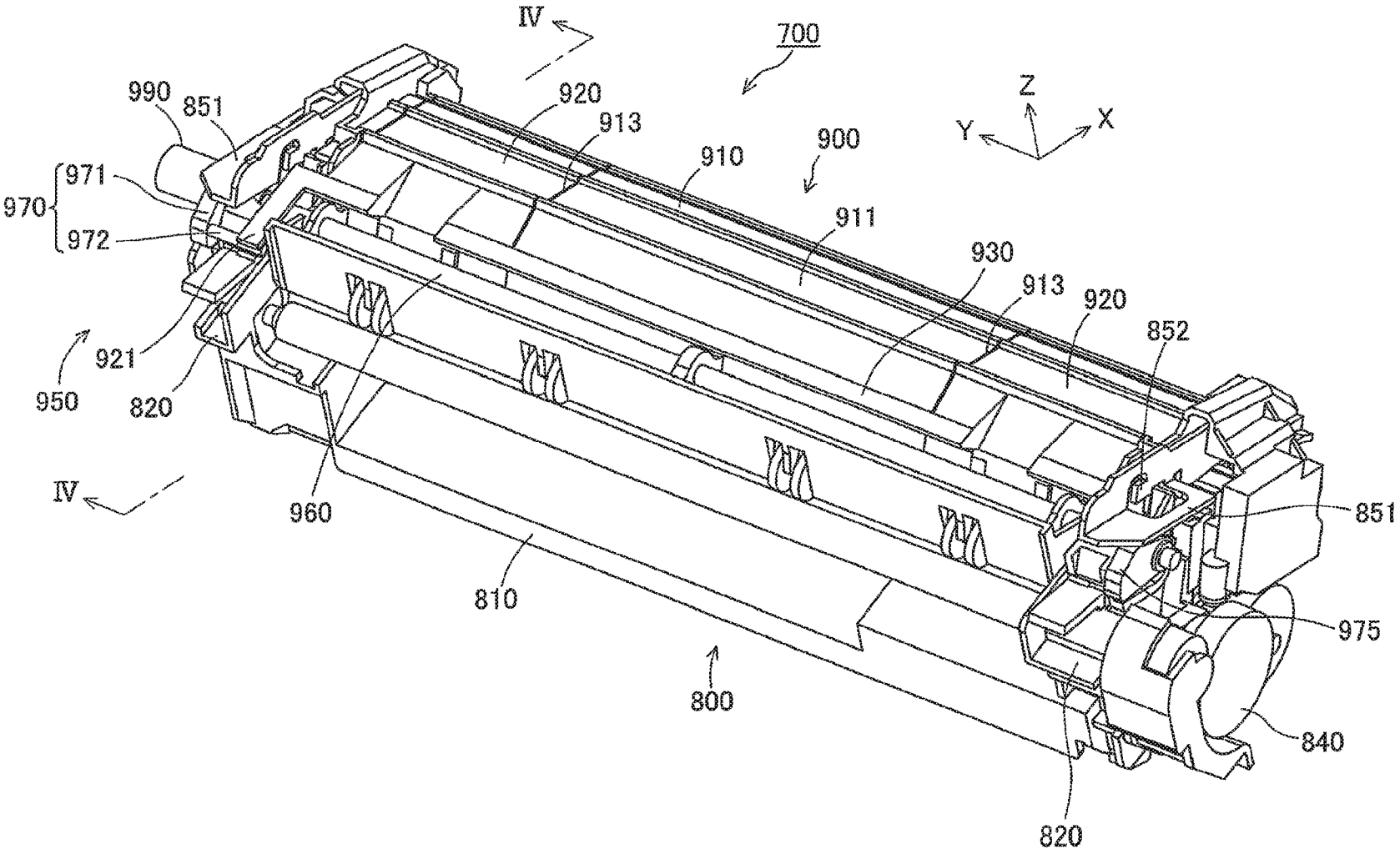
FIG. 2 is a perspective view of a fixing device used in the printer, and showing a closed state of a cover.
Figure 3:
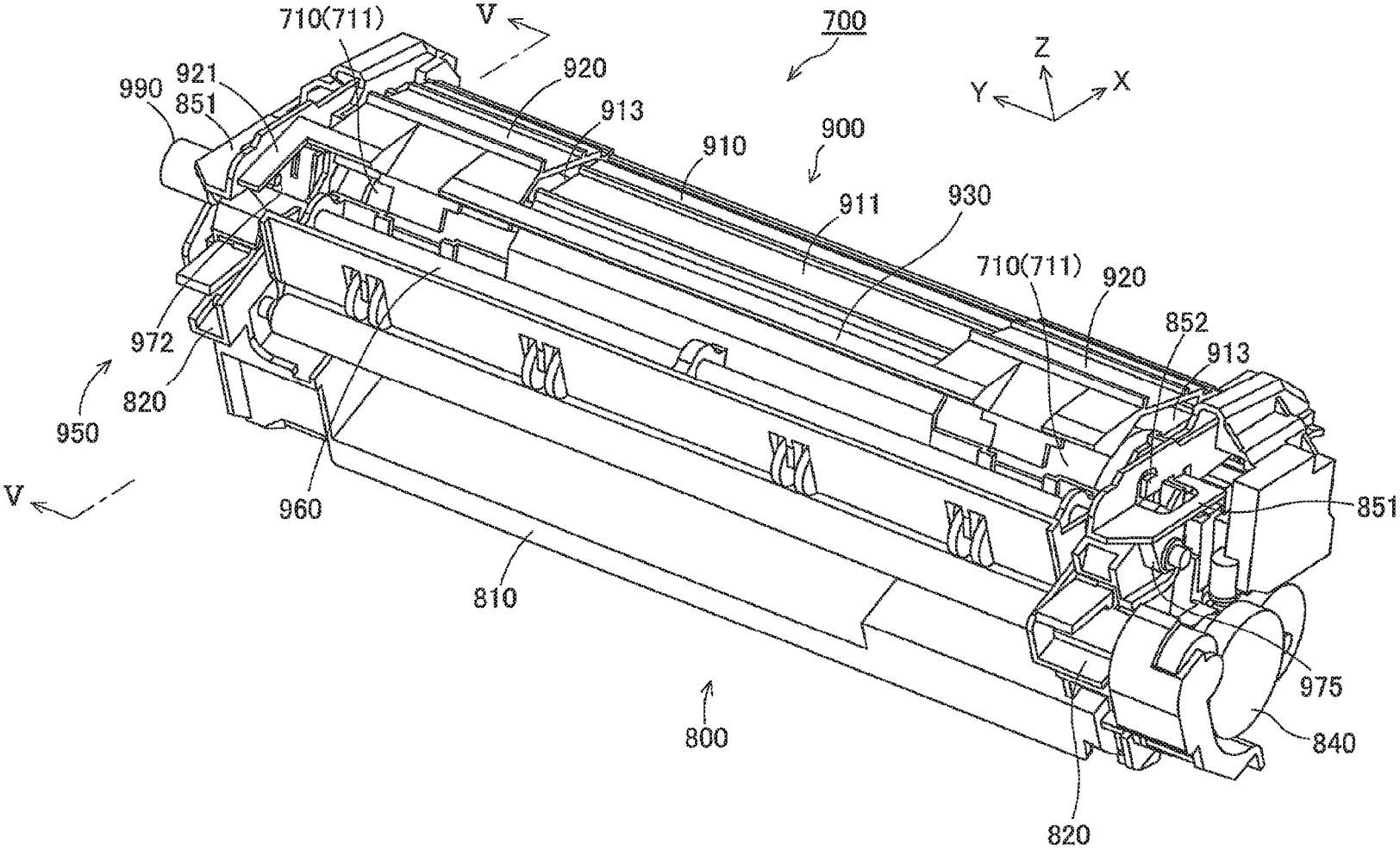
FIG. 3 is a perspective view of the fixing device and showing an open state of the cover.

As shown in FIGS. 1 through 3, the fixing unit 700 includes the heat unit 710, the opponent member 720, a lower cover 800, an upper cover 900, and a change-over mechanism 950. The upper cover 900 is an example of a cover.

The heat unit 710 is a hollow cylindrical shaped extending in a direction perpendicular to the conveying direction. That is, the heat unit 710 extends in leftward/rightward direction or widthwise direction of the sheet W. The heat unit 710 includes a fixing belt 711 and a halogen heater 712. The fixing belt 711 is in a form of a tubular member and is rotatable about an axis extending in the widthwise direction. The widthwise direction is an example of "predetermined axial direction". The halogen heater 712 is a heater adapted to generate heat upon receipt of electric power supplied from AC source (not shown). The halogen heater 712 is positioned in an internal space defined by the fixing belt 711. The opponent member 720 is a cylindrical member and is rotatable about an axis extending in the widthwise direction. The opponent member 720 is urged toward and in contact with the fixing belt 711. The one surface of the sheet W is in contact with an outer surface of the fixing belt 711.

By heat generation at the halogen heater 712, the fixing belt 711 is heated so that temperature of the fixing belt 711 is elevated. Further, by the rotation of the opponent member 720 by the driving force from the main motor (not shown), the fixing belt 711 is driven to be circularly moved. The sheet W moved past the process unit 600 reaches the position between the fixing belt 711 and the opponent member 720, and is heated by the fixing belt 711 while being conveyed by the fixing belt 711 and the opponent member 720.

As shown in FIGS. 2 through 6, the lower cover 800 is adapted to rotatably support the heat unit 710 and the opponent member 720 and is made from resin. More specifically, the lower cover 800 includes a lower wall portion 810, and a pair of side wall portions 820. The lower wall portion 810 is positioned below the opponent member 720 and is elongated in the widthwise direction such that each end of the lower wall portion 810 is positioned outward of each end of the heat unit 710 and each end of the opponent member 720 in the widthwise direction. Each side wall portion 820 extends upward from each end of the lower wall portion 810 and confronts each end of the heat unit 710 and each end of the opponent member 720. Each side wall portion 820 has a lower portion rotatably supporting the opponent member 720, and has an upper portion supporting the heat unit 710. More specifically, a side guide (not shown) is provided at the upper portion of each side wall portion 820 for guiding each widthwise end portion of the fixing belt 711. The side guide is slidably movable in upward/downward direction relative to the upper portion, so that the pressing force generated between the heat unit 710 and the opponent member 720 is changeable. The opponent member 720 has a left end portion provided with a drive gear 840. A driving force from the main motor (not shown) is transmitted to the drive gear 840. The opponent member 720 is rotationally driven by the rotation of the drive gear 840.

The lower cover 800 also includes a pair of arms 851 extending in frontward/rearward direction. Each arm 851 has a front end portion pivotally movably supported to an upper portion of each side wall portion 820, so that a rear end portion of each arm 851 is movable upward and downward. Each arm 851 has a hook 852. A compression spring (not shown) has one end portion connected to the hook 852 and another end portion connected to the side wall portion 820 so that the rear end portion of each arm 851 is urged toward the lower wall portion 810 of the lower cover 800. Each arm 851 supports each widthwise end portion of the heat unit 710 from below. Thus, in accordance with movement of each arm 851 in upward/downward direction, the heat unit 710 is moved in the upward/downward direction. The arm 851 is an example of a displacement member, and constitutes a pressure altering mechanism that changes pressing force between the heat unit 710 and the opponent member 720.

The upper cover 900 is positioned opposite to the opponent member 720 with respect to the heat unit 710 for covering an upper side of the heat unit 710. More specifically, the upper cover 900 is made from resin, and is arcuate cross-section along an outer surface of the heat unit 710 as viewed in the widthwise direction. The upper cover 900 is elongated having each widthwise end positioned outward of each widthwise end of the heat unit 710 and each widthwise end of the opponent member 720. The upper cover 900 is bridged over the pair of side wall portions 820 of the lower cover 800.

Figure 4:
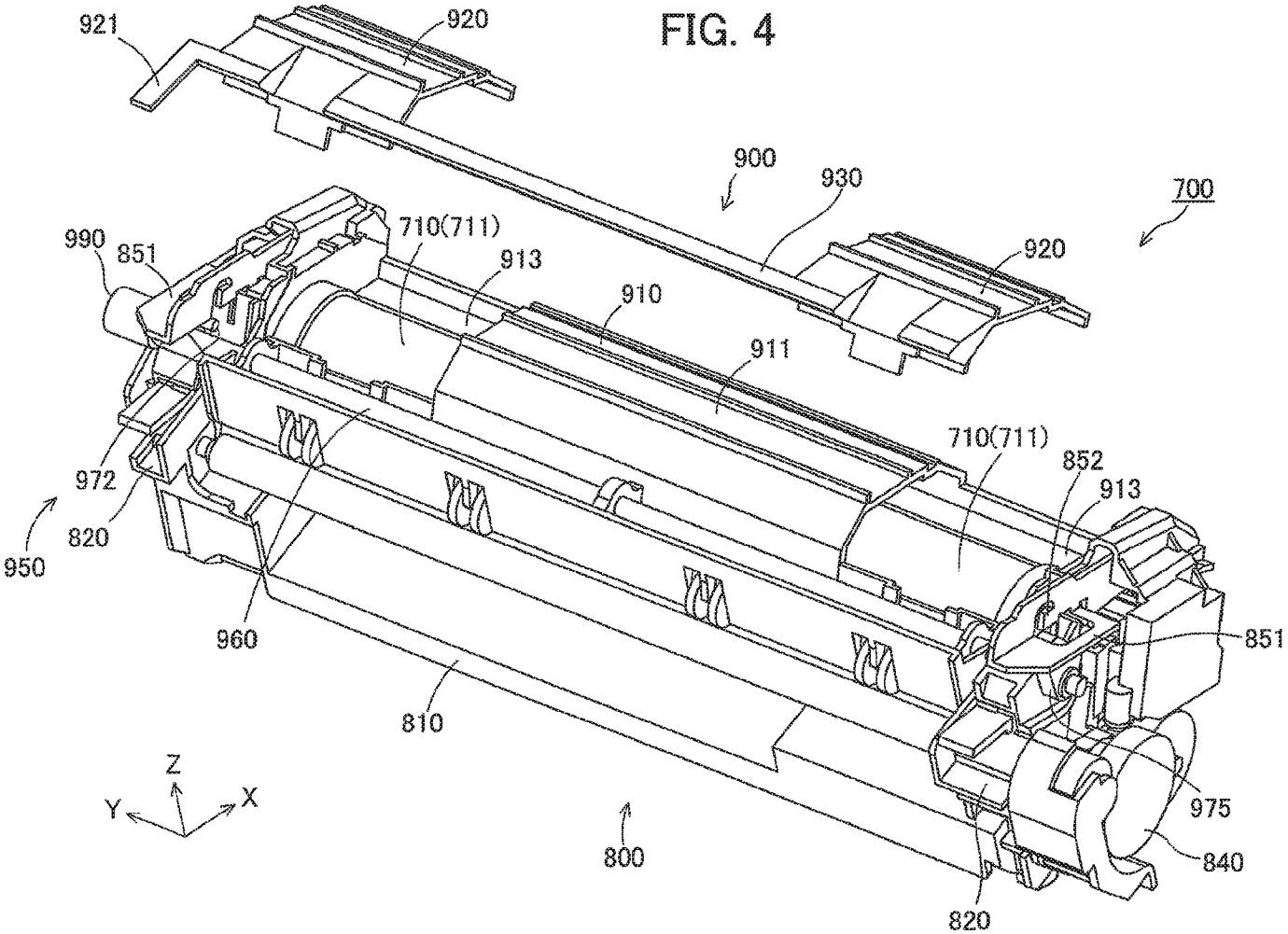
FIG. 4 is a perspective view of the fixing device in which a pair of covers and a connecting portion are separated from a remaining portion.
Figure 9:
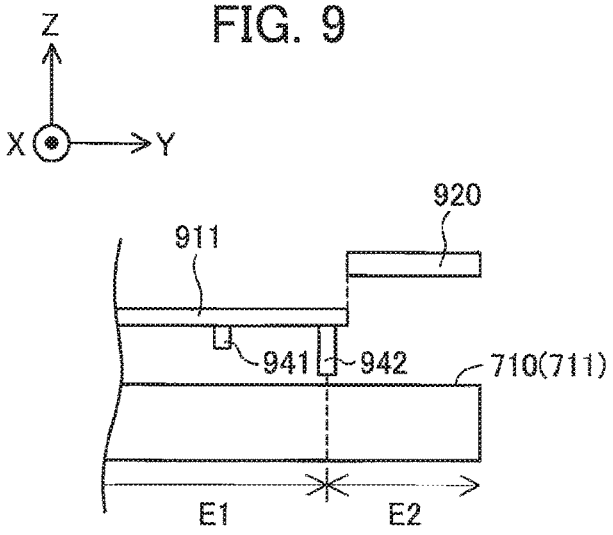
FIG. 9 is a view showing the upper cover and a heat unit as viewed from front.

The upper cover 900 includes a body portion 910, a pair of movable portions 920 and a coupling portion 930. The body portion 910 is a stationary portion, and has a central portion 911 in confrontation with a central region E1 (FIG. 9) of the heat unit 710 and widthwise end portions each formed with a through-hole 913 in confrontation with each end region E2 (FIG. 9). As shown in FIG. 4, the through-hole 913 is rectangular in shape as viewed in Z-direction. The central region E1 is an intermediate region in an outer peripheral surface of the heat unit 710 in the widthwise direction. The end region E2 is widthwise end region in the outer peripheral surface of the heat unit 710, and is positioned outward of the central region E1 in the widthwise direction.

Figure 5:
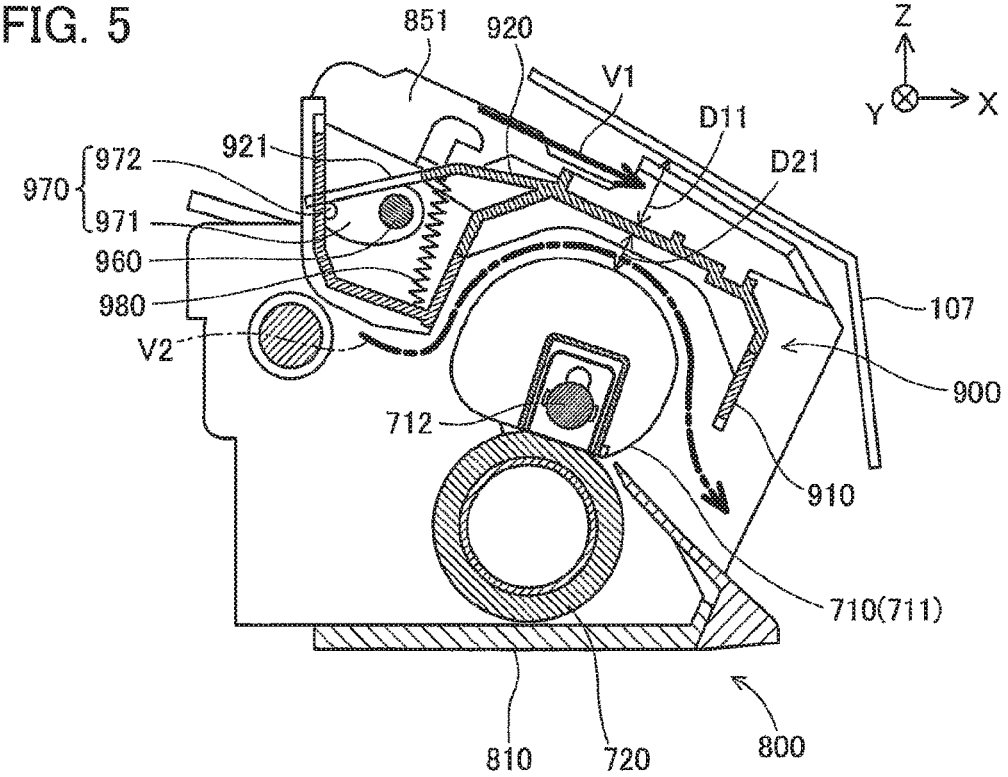
FIG. 5 is a cross-sectional view taken along a line IV-IV of FIG. 4 for showing X-Z cross-section.
Figure 6:
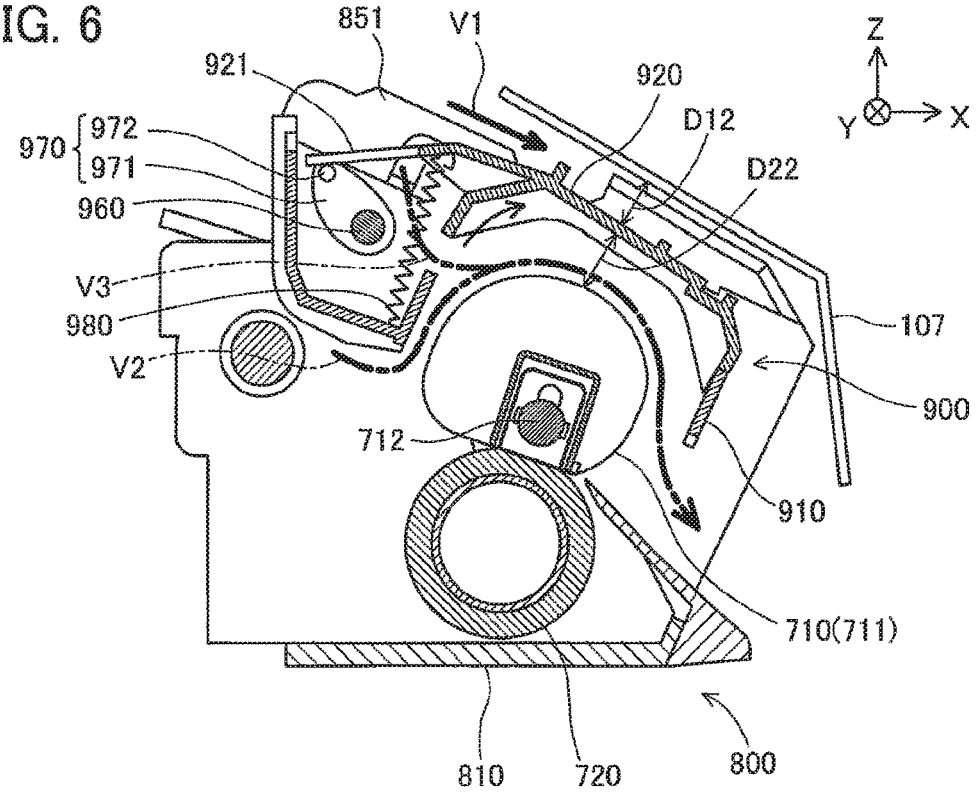
FIG. 6 is a cross-sectional view taken along a line V-V of FIG. 3 for showing X-Z cross-section.

The pair of movable portions 920 is positioned to cover the pair of through-holes 913. Each movable portion 920 has a front end portion pivotally movable relative to the body portion 910 so that each rear end portion of the movable portion 920 is movable toward and away from the body portion 910. Thus, each movable portion 920 is movable between a closed position closing each through hole 913 as shown in FIGS. 2 and 5, and an open position at which a rear portion of the through-hole 913 is open as shown in FIGS. 3 and 6. The closed position is an example of a "first position", and the open position is an example of a "second position".

Thus, a distance between the central portion 911 of the body portion 910 and the central region E1 of the heat unit 710 is maintained unchanged, whereas a distance between the rear end portion of the movable portion 920 and the end region E2 of the heat unit 710 can be changed. The central portion 911 is an example of a "central cover portion", the movable portion 920 is an example of a "side cover portion", the pair of movable portions 920 is examples of "first side cover portion" and "second side cover portion".

A protruding portion 921 extends rearward from one of the movable portions 920 (right movable portion 920) as shown in FIGS. 2 through 4. The protruding portion 921 is positioned outward of the end region E2 in the widthwise direction.

The coupling portion 930 has each end portion coupled to each movable portion 920 as best shown in FIG. 4. Thus, the pair of movable portions 920 are pivotally movable together in accordance with vertical movement of the protruding portion 921.

The change-over mechanism 950 includes a shaft 960, a first cam 970, a second cam 975, a biasing spring 980, and a drive motor 990. The shaft 960 is positioned behind the heat unit 710 and is rotatably supported to the pair of side wall portions 820 of the lower cover 800. The first cam 970 is fixed to a right end portion of the shaft 960. The first cam 970 includes a cam body portion 971 and a pin 972. The cam body portion 971 is positioned below a rear end portion of the right arm 851 and is fixed to the shaft 960. The pin 972 protrudes leftward from a left side surface of the cam body portion 971. The tip end of the pin 972 is positioned below the protruding portion 921 of the right movable portion 920. The first cam 970 is an example of a "supporting member". A second cam 975 is fixed to a left end portion of the shaft 960. The second cam 975 has a shape the same as the shape of the cam body portion 971 of the first cam 970, and does not include the member corresponding to the pin 972.

The biasing spring 980 is coupled between the body portion 910 and either one of the protruding portion 921 and a front end portion of the movable portion 920 with being stretched therebetween, so that the rear end portions of the pair of movable portions 920 are urged toward the closed position because of a restoration force of the biasing spring 980. The biasing spring 980 is an example of an "urging unit". The drive motor 990 is connected to the shaft 960 through gears (not shown) to rotatably drive the shaft 960. The drive motor 990 is an example of a "drive source".

Figure 8:
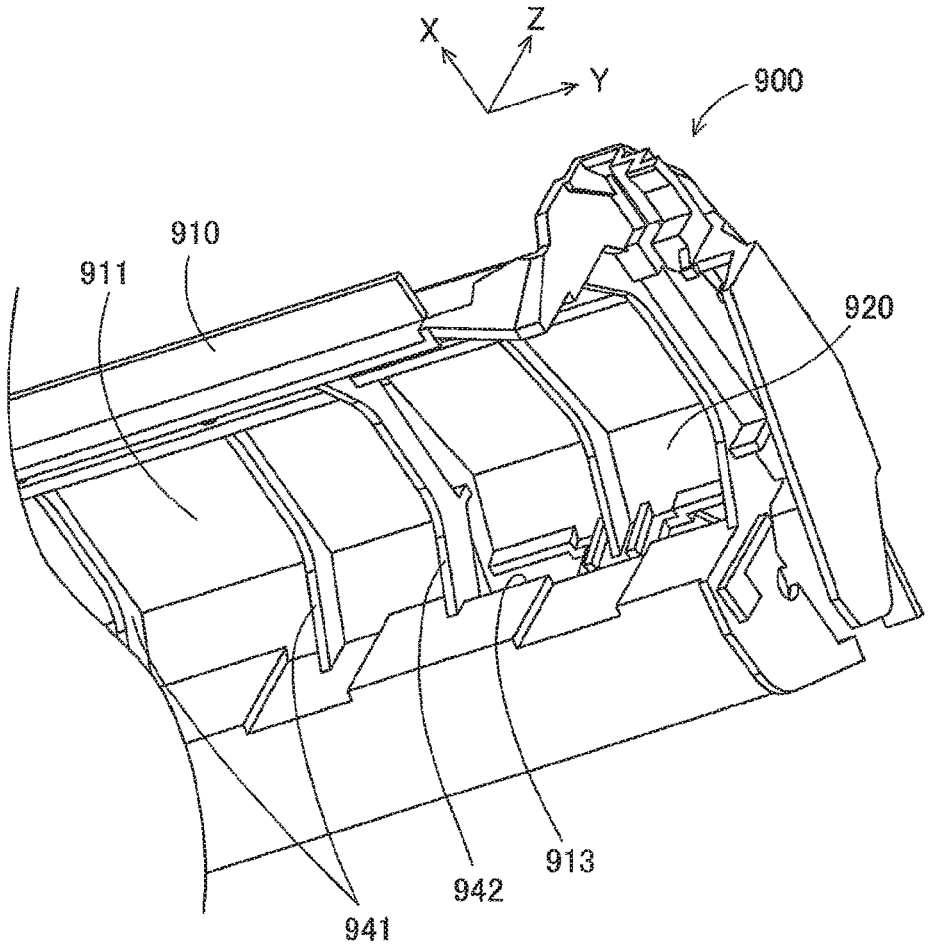
FIG. 8 is a partial perspective view of an internal right end portion of an upper cover in the fixing device.

It should be noted that the movable portion 920 shown in FIGS. 8 and 9 is in an open position. A plurality of first ribs 941 and two second ribs 942 extending in a rotation direction of the heat unit 710 are formed on the internal surface of the central portion 911 of the body portion 910 to reinforce the body portion 910. The plurality of first ribs 941 are provided in predetermined intervals in the widthwise direction, and are positioned within widthwise end portions of the central portion 911. Each of the second rib 942 is provided on each widthwise end portion of the central portion 911. The protruding length of the second rib 942 from the internal surface of the central portion 911 toward the heat unit 710 is longer than that of the first rib 941. The second rib 942 is an example of a "rib".

Opening/closing operation of the movable portions 920 will next be described. In this description, the widthwise direction is defined as a direction perpendicular to the conveying direction. In this embodiment, the printer 10 accommodates two types of sheets W in the tray 210, and each of the two types of sheets W has a size in the widthwise direction different from each other. When a wide sheet W having a relatively larger size in the width direction (designated as "a wide sheet W" hereinafter) is accommodated in the tray 210 and transferred into the fixing unit 700, the wide sheet W passes through the pair of end region E2 of the heat unit 710 as well as the central region E1. On the other hand, when a narrow sheet W having a relatively narrower size in the width direction (designated as "a narrow sheet W" hereinafter) is accommodated in the tray 210 and transferred into the fixing unit 700, the narrow sheet W does not pass through the pair of end regions E2, but only passes through the central region E1 of the heat unit 710. Accordingly, the end regions E2 of the heat unit 710 has a temperature higher than that of the central region E1, which would lead to the temperature increase at the end regions.

In this embodiment, the printer 10 has a sensor (not shown) for detecting a width of the sheet W accommodated in the tray 210. A controller (not shown) in the printer 10 determines which a wide sheet W or a narrow sheet W is accommodated in the tray 210 in response to a detection signal from the sensor and/or size-information of the sheet W inputted by a user. When it is determined that the wide sheet W is accommodated in the tray 210, the first cam 970 and the second cam 975 are angularly rotated to the first angular rotational position shown in FIG. 5 by a driving force from the drive motor 990. At this time, each of the movable portions 920 is at the closed position. Rotation of the fan 106 generates a first airflow V1 and a second airflow V2. The first airflow V1 flows from the discharge opening 110 to the space between the movable portion 920 and the wall portion 107. The second airflow V2 flows from the discharge opening 110 to the space between the upper cover 900 and the heat unit 710 through the space below the upper cover 900. The distance between the movable portion 920 and the heat unit 710 is equal to the distance D21 between the central portion 911 and the heat unit 710. The distance D21 is an example of a "reference distance". Accordingly, the flow rate of the second airflow V2 passing through the central region E1 is the same as the flow rate of the second airflow V2 passing through the end region E2, and thus, cooling to the central region E1 is the same as the cooling to the end region E2. In this case, the distance between the movable portion 920 and the wall portion 107 is regarded as the distance D11.

On the other hand, when it is determined that the narrow sheet W is accommodated in the tray 210, the shaft 960 is rotatably driven by a driving force from the drive motor 990, so that the first cam 970 and the second cam 975 are angularly rotated from the first angular rotational position shown in FIG. 5 to the second angular rotational position shown in FIG. 6. During this motion, the pin 972 is brought into contact with the protruding portion 921 to push the protruding portion 921 upward. Accordingly, each of movable portions 920 is changed to the open position. At this time, the distance D12 between the movable portion 920 and the wall portion 107 is shorter than the distance D11 when the movable portion 920 is at the closed position. Further, the distance D22 between the movable portion 920 and the heat unit 710 is longer that the distance D21 when the movable portion 920 is at the closed position. When the fan 106 rotates, a third airflow V3 is generated in addition to the above-described first airflow V1 and second airflow V2. The third airflow V3 flows from the discharge opening 110 to the space between the movable portion 920 and the end region E2 of the heat unit 710 through the through-hole 913 of the body portion 910. Accordingly, the flowing rate of the airflow flowing between the movable portion 920 and the end region E2 of the wall portion 107 (the second airflow V2 and the third airflow V3) is increased by the decreased flowing rate of the first airflow V1 flowing between the movable portion 920 and the wall portion 107 in comparison with the state where the movable portion 920 is at the closed position. Consequently, the cooling effect for the end region E2 becomes higher than the cooling effect for the central region E1 of the heat unit 710, so that the temperature increase at the end regions of the heat unit 710 can be restrained.

When the first cam 970 and the second cam 975 are positioned at the second angular rotational position, the first cam 970 and the second cam 975 do not contact the pair of arms 851. Therefore, the pressing force between the heat unit 710 and the opponent member 720 is equal to the pressing force between the heat unit 710 and the opponent member 720 when the first cam 970 and the second cam 975 are at the first angular rotational position. The posture of the arm 851 at this time is an example of a "first posture". The pressing force is an example of a first pressing force.

Figure 7:
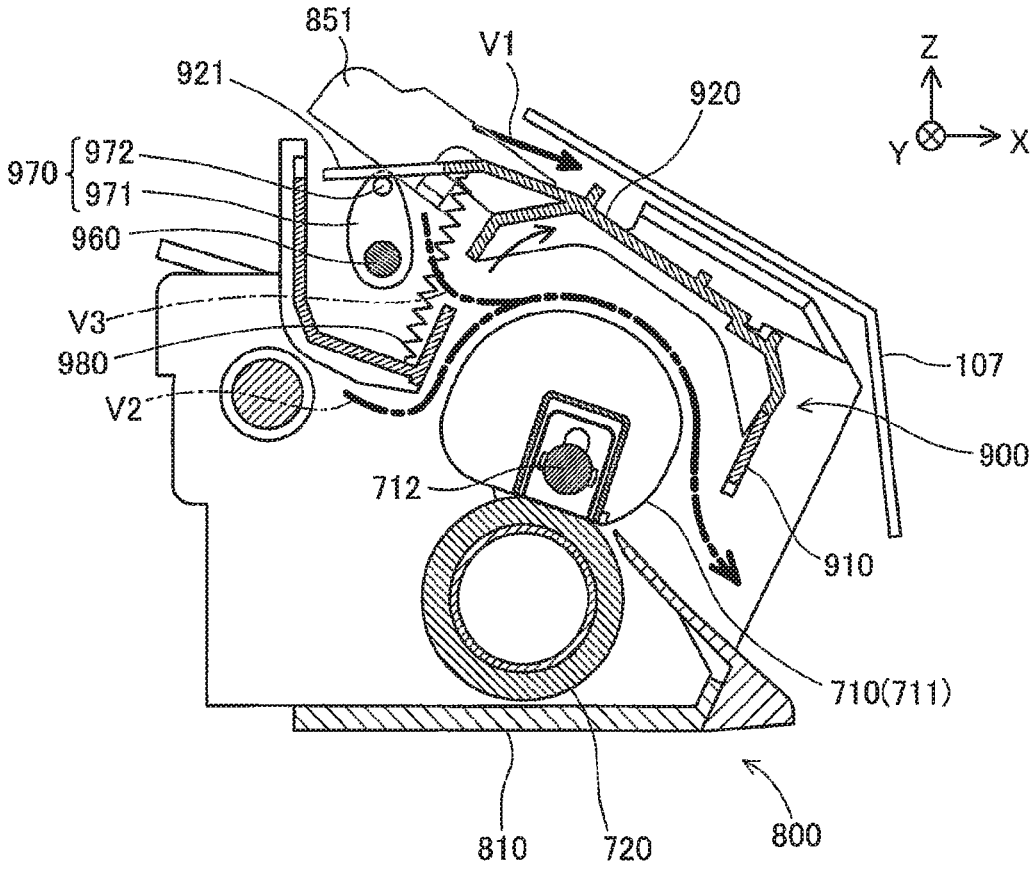
FIG. 7 is a view for schematically illustrating the X-Z cross-section of the fixing device.

On the other hand, when paper jam at the fixing unit 700 is detected by the controller for example, the first cam 970 and the second cam 975 are further rotationally driven in a clockwise direction as shown in FIG. 7 more than the second angular rotational position shown in FIG. 6. The angular rotational position at this time is an example of a "third angular rotational position". During this motion, the first cam 970 and the second cam 975 are brought into contact with the pair of arms 851 to push the pair of arms 851 upward. As a result, the pressing force between the heat unit 710 and the opponent member 720 becomes smaller than the pressing force between the heat unit 710 and the opponent member 720 when the first cam 970 and the second cam 975 are positioned at the first or second angular rotational position. The posture of the arm 851 in FIG. 7 is an example of a "second posture". The pressing force is an example of a "second pressing force". Accordingly, paper jam at the fixing unit 700 can be solved easily. When the first cam 970 and the second cam 975 are rotatably driven to the third angular rotational position, the movable portion 920 is positioned at the open position, as shown in FIG. 7. However, the movable portion 920 may be positioned at the closed position.

According to the above-described embodiment, the airflow generated by the air discharge fan 106 is divided into the first airflow flowing between the wall portion 107 of the housing 100 and the movable portion 920 and the second airflow flowing between the movable portion 920 and the heat unit 710. By moving the movable portion 920 of the body portion 910 between the closed position and the open position, the flow rate of the first airflow and the flow rate of the second airflow can be changed relatively. More specifically, when the movable portion 920 is at the open position, the distance between the wall portion 107 of the housing 100 and the movable portion 920 is smaller than that when the movable portion 920 is at the closed position. At the same time, when the movable portion 920 is at the open position, the distance between the movable portion 920 and the heat unit 710 is greater than the distance therebetween when the movable portion is at the closed position. As a result, the flow rate of the airflow generated by the air discharge fan 106 and flowing between the movable portion 920 and the heat unit 710 is increased when the movable portion 920 is at the open position. Accordingly, cooling effect to the end region E2 of the heat unit 710 becomes higher than the cooling effect to the central region E1 of the heat unit 710, so that temperature increase at the end regions can be restrained. Further, in this embodiment, the movable portion 920 which is a part of the upper cover 900 can be moved. This structure prevents the fixing unit 700 from being complicated in comparison with a structure in which the cover and the cooling mechanism are separated from each other. And, temperature increase at the end regions can be restrained.

Further, according to the embodiment, the driving force from the drive motor 990 drives the first cam 970, which causes the movable portion 920 to be displaced between the closed position and the open position. As a result, this structure prevents the fixing unit from becoming bulky. Further, the first cam 970 is rotatably driven by the shaft 960. This structure ensures flexibility for the geometrical arrangement of the drive motor 990 and the first cam 970, and the movable portion 920 can be displaced with relatively simple structure. By using a cam mechanism, the movable portion 920 can be moved with relatively simple structure.

Further, in the embodiment, biasing force of the spring 980 can prevent the movable portion 920 and the first cam 970 from moving away from each other. Accordingly, the movable portion 920 can be easily and reliably moved to the closed position and to the open position.

Further, in the embodiment, by providing the pressure altering mechanism, the movement of the movable portion 920 and change in pressing force can be performed in conjunction with the rotation of the first cam 970. Further, rotation of the single first cam 970 causes the movement of the movable portion 920 and the change in the pressing force. Further, the coupling portion 930 allows the left and right movable portions 920 to be moved in response to the rotation of the single first cam 970, and the movement of the single first cam 970 can lead to the change in pressing force.

Further, in the embodiment, the second ribs 942 can provide heat retainability between the central portion 911 and the central region E1 of the heat unit 710 (FIG. 9) even when the movable portions 920 are at the open position.

Various modifications are conceivable. For example, in the above-described embodiment, the first cam 970 is an example of "a support member". However, the support member is not limited to the first cam 970 but may be a linking mechanism which includes a circular member formed with an arcuate groove and eccentrically rotatable with the shaft 960, and a connecting arm having one end portion slidably-supported to the groove and another end portion pivotally movably connected to a rear end portion of the movable portion 920.

Further, in the above-described embodiment, at least one of the second rib 942, the biasing spring 980, and the pressure altering mechanism for the pressing force may be omitted.

Further, when the first cam 970 and the second cam 975 are positioned at the third angular rotational position, the movable portion 920 may be at either one of the closed position and the open position.

Further, in the above-described embodiment, the shaft 960 and the first cam 970 are commonly used in the change-over mechanism 950 for the movable portion 920 and the pressure altering mechanism for changing pressing force. However, at least one of the shaft 960 and the first cam 970 can be commonly used for the change-over mechanism 950 and the pressure altering mechanism, and another shaft and another cam may be provided for the one of the change-over mechanism 950 and the pressure altering mechanism.

Further, in the above-described embodiment, the rear end portions of the movable portions 920 is moved upward or downward. However, the movement of the movable portions 920 is not limited to the above, but the front end portions of the movable portions 920 or the movable portion 920 in its entirety can be moved upward or downward.

Further, in the above embodiment, a blast fan may be provided in the rear portion of the housing 100 to supply air from outside into the space S through a gap between the first re-conveying guide 161 and the conveying guide 150. With this structure, while a wide sheet W is passing on the re-conveying passage R2, the airflow from the blast fan is interrupted by the wide sheet W, which prevents the airflow from being directly blown to the entire heat unit 710. On the other hand, while a narrow sheet W is passing on the re-conveying passage R2, only the airflow from the blast fan to the central region E1 of the heat unit 710 is interrupted, whereas the airflow from the blast fan to the end region E2 of the heat unit 710 is not interrupted. Accordingly, the temperature increase at the end regions can be effectively restrained.

In the above-described embodiment, the printer 10 is configured to convey both of the wide sheet W and the narrow sheet W on the conveying passage R1 and the re-conveying passage R2, in the manner that the central position of the sheets W in a width direction is coincident with the central position of the conveying passage R1 and the re-conveying passage R2. However, the printer 10 is not limited to such printer. For example, each of the wide sheet W and the narrow sheet W can be passed on the conveying passage R1 and the re-conveying passage R2 in such a manner that the side edge of the wide sheet W or the narrow sheet W is aligned with the side edge of the conveying passage R1 and the re-conveying passage R2. In the latter case, the fixing unit 700 may be provided with a single movable portion 920.

Further, in the above-described embodiment, the shaft 960 and the first cam 970 are rotatably driven by the driving force from the drive motor 990. However, the embodiment is not limited to this structure. For example, the shaft 960 and the first cam 970 may be rotated by a user, or rotated in conjunction with the pivotal operation of a cover (not shown) of the housing 100.

Further, the configuration of the printer 10 in the above embodiment is merely an example and may be modified. In the above embodiment, the printer 10 is a monochromatic printer with a single-color toner (black). However, a type of color to be printed and number of colors are not limited to the above embodiment. The printer 10 may include a printer for printing both side of sheet W and a printer for printing a single side of sheet W.

Further, the image forming apparatus may include not only a printer, but also a copy machine, a facsimile machine, and a multi-function apparatus.

Further, in the above-described embodiment, the fixing unit 700 includes the tubular fixing belt 711. However, the fixing belt is not limited to the fixing belt 711 and may be a fixing roller.

While the description has been made in detail with reference to specific embodiment, it would be apparent to those skilled in the art that various changes and modifications may be made without departing from the spirit and scope of the above described embodiment.

What is claimed is:

1. An image forming apparatus comprising:

a housing comprising a fan, and a wall portion; and a fixing device comprising:

a casing having an upper cover and providing an inner space, the upper cover and the wall portion defining an air passage in communication with the fan;

a heat unit provided in the inner space and extending in an axial direction, the heat unit comprising a heater, the heat unit having a central region in the axial direction and an end region positioned outside of the central region in the axial direction, the upper cover being positioned between the heat unit and the wall portion; and an opponent member provided to face the heat unit in a direction perpendicular to the axial direction;

wherein the upper cover comprises:

a central cover portion positioned to face the central region and spaced away from the central region by a reference distance; and a side cover portion positioned to face the end region and movable between a first position providing a first distance from the heat unit and a second position providing a second distance from the heat unit, the first distance being equal to or less than the reference distance, and the second distance being greater than the reference distance, and wherein operation of the fan causes a first air flow flowing through the air passage, and movement of the side cover portion from the first position to the second position directs a part of the first air flow flowing through the air passage into the inner space to increase an amount of a second air flow flowing through the inner space.

2. The image forming apparatus according to claim 1, further comprising:

a drive source; and a support member configured to be rotatably driven by the drive source and supporting the side cover portion, the support member being configured to be rotated to a first rotational position to maintain the side cover portion at the first position, and to be rotated to a second rotational position different from the first rotational position to maintain the side cover portion at the second position.

3. The image forming apparatus according to claim 2, further comprising:

a shaft extending in the axial direction and having an axis;

wherein the support member is fixed to the shaft, and wherein the drive source is configured to drive rotation of the shaft about the axis.

4. The image forming apparatus according to claim 2, wherein the support member comprises a cam in contact with the side cover portion.

5. The image forming apparatus according to claim 2, further comprising an urging member configured to urge the side cover portion toward the support member.

6. The image forming apparatus according to claim 2, further comprising a pressure altering mechanism configured to change a pressing force between the heat unit and the opponent member in accordance with rotation of the support member.

7. The image forming apparatus according to claim 6, wherein the pressure altering mechanism comprises a displacement member configured to selectively provide a first posture at which the pressing force is at a first pressing force and a second posture at which the pressing force is at a second pressing force less than the first pressing force, and wherein the displacement member is configured to be maintained in the first posture when the support member is rotated within a range between the first rotational position and the second rotational position, and the support member is configured to change the displacement member from the first posture to the second posture, when the support member is rotated to a third rotational position different from the first rotational position and the second rotational position.

8. The image forming apparatus according to claim 2, wherein the end region includes a first end region and a second end region opposite to the first end region with respect to the central region, and wherein the side cover portion comprises:

a first side cover portion facing the first end region;

a second side cover portion facing the second end region; and a coupling portion connecting the first side cover portion and the second side cover portion, the support member supporting at least one of the first side cover portion and the second side cover portion.

9. The image forming apparatus according to claim 1, further comprising a rib protruding toward the heat unit from an end portion of the central cover portion in the axial direction.

10. A fixing device comprising:

a casing having an upper cover and providing an inner space;

a heat unit extending in an axial direction and comprising a heater, the heat unit having a central region in the axial direction and an end region positioned outside of the central region in the axial direction;

an opponent member provided to face the heat unit in a direction perpendicular to the axial direction, the upper cover being positioned opposite to the opponent member with respect to the heat unit, wherein the upper cover comprises:

a central cover portion positioned to face the central region and spaced away from the central region by a reference distance; and a side cover portion positioned to face the end region and movable between a first position providing a first distance from the heat unit and a second position providing a second distance from the heat unit, the first distance being equal to or less than the reference distance, and the second distance being greater than the reference distance, and wherein movement of the side cover portion from the first position to the second position allows an air flow flowing outside the casing and along the upper cover to be directed into the inner space.

11. The fixing device according to claim 10, further comprising:

a support member configured to be rotatably driven by a drive source and supporting the side cover portion, the support member being configured to be rotated to a first rotational position to maintain the side cover portion at the first position, and to be rotated to a second rotational position different from the first rotational position to maintain the side cover portion at the second position.

12. The fixing device according to claim 11, further comprising:

a shaft extending in the axial direction and having an axis, wherein the support member is fixed to the shaft, and wherein the drive source is configured to drive rotation of the shaft about the axis.

13. The fixing device according to claim 11, wherein the support member comprises a cam in contact with the side cover portion.

14. The fixing device according to claim 11, further comprising an urging member configured to urge the side cover portion toward the support member.

15. The fixing device according to claim 11, further comprising a pressure altering mechanism configured to change a pressing force between the heat unit and the opponent member in accordance with rotation of the support member.

16. The fixing device according to claim 15, wherein the pressure altering mechanism comprises a displacement member configured to selectively provide a first posture at which the pressing force is at a first pressing force and a second posture at which the pressing force is at a second pressing force less than the first pressing force, and wherein the displacement member is configured to be maintained in the first posture when the support member is rotated within a range between the first rotational position and the second rotational position, and the support member is configured to change the displacement member from the first posture to the second posture, when the support member is rotated to a third rotational position different from the first rotational position and the second rotational position.

17. The fixing device according to claim 11, wherein the end region includes a first end region and a second end region opposite to the first end region with respect to the central region, and wherein the side cover portion comprises:

a first side cover portion facing the first end region;

a second side cover portion facing the second end region; and a coupling portion connecting the first side cover portion and the second side cover portion, the support member supporting at least one of the first side cover portion and the second side cover portion.

18. The fixing device according to claim 10, further comprising a rib protruding toward the heat unit from an end portion of the central cover portion in the axial direction.

19. A fixing device comprising:

a heater, a tubular member extending in an axial direction and having an outer peripheral surface, the tubular member being heated by the heater, the outer peripheral surface having a central region in an axial direction and an end region positioned outside of the central region in the axial direction;

a cover extending in the axial direction, the cover having an arcuate shape along the outer peripheral surface of the tubular member in a cross section perpendicular to the axial direction, the cover being positioned outside of the outer peripheral surface of the tubular member in a direction perpendicular to the axial direction, the cover including:

a main member having a central portion and an end portion positioned outside of the central portion in the axial direction, the central portion facing the central region of the outer peripheral surface of the tubular member, the main member having a hole formed in the end portion at a position facing the end region of the outer peripheral surface of the tubular member, and a side cover positioned to cover the hole and facing the end region of the outer peripheral surface of the tubular member, the side cover having a protrusion extending in a first direction perpendicular to the axial direction;

a spring coupled between the main member and the protrusion, the spring being configured to urge the side cover toward the hole;

a shaft extending in the axial direction, the shaft being positioned between a first connecting portion at which one end of the spring is connected to the main member and a second connecting portion at which an other end of the spring is connected to the protrusion in a second direction perpendicular to the axial direction and crossing the first direction; and a cam fixed to the shaft to be contacted with the protrusion, the cam being positioned between the first connecting portion and the second connecting portion.

20. The fixing device according to claim 19, further comprising:

a roller extending in the axial direction and configured to contact the outer peripheral surface of the tubular member, wherein the tubular member is disposed between the roller and the cover in the second direction.

* * * * *